US008632134B2

(12) United States Patent
Klabisch et al.

(10) Patent No.: US 8,632,134 B2
(45) Date of Patent: Jan. 21, 2014

(54) CARRIAGE FOR A RECOVERY PLOUGH

(75) Inventors: Adam Klabisch, Dortmund (DE); Norbert Hesse, Bochum (DE); Gerhard Siepenkort, Lunen (DE); Klaus Duhnke, Werne (DE); Diedrich Bettermann, Unna (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 861 days.

(21) Appl. No.: 12/741,555

(22) PCT Filed: Oct. 31, 2008

(86) PCT No.: PCT/EP2008/009207

§ 371 (c)(1),
(2), (4) Date: May 5, 2010

(87) PCT Pub. No.: WO2009/059724

PCT Pub. Date: May 14, 2009

(65) Prior Publication Data

US 2010/0263569 A1 Oct. 21, 2010

(30) Foreign Application Priority Data

Nov. 6, 2007 (DE) ..... 10 2007 053 206

(51) Int. Cl.
*E21C 27/34* (2006.01)

(52) U.S. Cl.
USPC ..... 299/34.1

(58) Field of Classification Search
USPC ..... 299/34.1, 42, 43
See application file for complete search history.

(56) References Cited

U.S. PATENT DOCUMENTS

| | | | | |
|---|---|---|---|---|
| 3,113,762 | A | 12/1963 | Herrmann | |
| 3,151,912 | A * | 10/1964 | Herrmann | 299/34.06 |
| 6,769,742 | B2 | 8/2004 | Siepenkort | |

FOREIGN PATENT DOCUMENTS

| | | | |
|---|---|---|---|
| DE | 2438651 | A1 | 2/1976 |
| DE | 9416657 | U1 | 2/1995 |
| DE | 20103704 | U1 | 7/2001 |
| DE | 102006027955 | A1 | 12/2007 |
| PL | 211947 | | 7/2012 |
| SU | 1564337 | A * | 5/1990 |

* cited by examiner

*Primary Examiner* — Sunil Singh
(74) *Attorney, Agent, or Firm* — Foley & Lardner LLP

(57) ABSTRACT

A traction carriage for an underground mining plow, comprising a traction carriage body which can be inserted into a cavity in a plow body and which on the rear side of a guide recess has a front part whose ends pointing in the direction of travel form stop surfaces for interacting with counterstop surfaces in the cavity of the plow body. According to the invention, a damping device having a damping action in both directions of travel is integrated into the front part of the traction carriage. In order to provide a low-maintenance damping device which allows a more favorable transmission of force between the stop surface on the traction carriage and the counterstop surface on the plow body, the coupling piece can be moved relative to the stop surfaces counter to the restoring force of a damping system of the damping device that is arranged between the stop surfaces.

31 Claims, 4 Drawing Sheets

CARRIAGE FOR A RECOVERY PLOUGH

The invention relates to a traction carriage for an underground mining plow, comprising a traction carriage body which can be inserted into a cavity in a plow body and which on the rear side of a guide recess has a coupling piece for fastening a plow chain and on the front side of the guide recess has a front part whose ends pointing in the direction of travel form stop surfaces for interacting with counterstop surfaces in the cavity of the plow body, wherein a damping device having a damping action in both directions of travel is integrated into the front part of the traction carriage. The present invention relates to an additional application to German patent application DE 10 2006 027 955, to whose disclosure contents reference is made and which is incorporated by reference into the specification of this application including any English versions thereof.

In the main application DE 10 2006 027 955, which is not a prior publication, the damping device comprises a rod which projects on both sides beyond the stop surfaces on the front part and whose length is greater than the spacing of the stop surfaces from one another, wherein the rod in each case has a fixed stop for a disk spring assembly by means of which a restoring force is generated which is intended to prevent the rod end being completely pressed into the front part. The disk spring assemblies used are intended, through the projection of the rod front end beyond the stop surface, to generate a damping which can withstand, for example, forces of up to 500 kN (kilonewton) for each direction of travel before the rod end is completely inserted into the front part. Only then would the damping device lose its damping action.

A further mining plow having a traction carriage body which can be inserted in a cavity in the plow body is known from DE 43 00 534 A1. In this embodiment, the traction carriage sits relatively loosely in the cavity, for which reason the traction carriage and plow can be adapted body-independently of one and another to the profile of the plow guide without, however, a damping being produced.

According to the invention of this application, provided is a traction carriage for a mining plow which is provided with a damping device which is low-maintenance and allows a more favorable transmission of force between the stop surface on the traction carriage and the counterstop surface on the plow body.

More particularly, this object is achieved according to the invention in that the coupling piece can be moved relative to the stop surfaces counter to the restoring force of a damping system of the damping device that is arranged between the stop surfaces. In the solution according to the invention it is possible, other than in the main patent, for a complete, large-area contact to be maintained between the stop surfaces on the one hand and the counterstop surfaces on the plow body on the other hand, since parts of the damping device which project beyond the stop surfaces are dispensed with. Instead, according to the invention, the damping system is situated completely between the stop surfaces and the damping system damps relative movements between the stop surfaces arranged with a fixed spacing from one another on the one hand and the coupling piece on the other hand.

In the preferred embodiment, a receiving body which is connected fixedly in terms of movement to the coupling piece and is intended to receive the damping system is provided. The stop surfaces can preferably form the ends of a sliding sleeve in whose interior the receiving body for the damping system is arranged. The inner sides of the stop surfaces can here form movement end stops which limit the maximum displacement travel of the coupling piece relative to the end stops and therefore relative to the counterstop surfaces or the cavity in the plow body. The receiving body can at the same time take over the guidance between the receiving body and sliding sleeve and for this purpose be provided in particular with guide means. As a result of the multipart design of the front part and the arrangement of the two stop surfaces with uniform spacing on a sliding sleeve, a substantially longer damping travel can be achieved than in the solution according to the main patent.

In the particularly preferred embodiment, the damping system has for each direction of travel a damping plunger whose plunger shaft projects from the receiving body and which is displaceable counter to the restoring force of at least one damping element relative to the other damping plunger. Each damping plunger can preferably have a plate which is arranged in the receiving body and on whose front side the plunger shaft is formed and against whose rear side the damping element or elements press or bear. The damping is therefore achieved by a reduction of the spacing of the inner side of the stop surface lying at the front in the direction of travel from the associated end side of the receiving body, wherein the change in the spacing between the receiving body and stop surfaces builds up a restoring force which is stored in the damping elements and which, with an increasing reduction of the spacing, can rise for example from 100 kN in the starting state to approximately 500 kN in the end position of the relative displacement.

In order, in spite of the relative displacement between the receiving body and sliding sleeve, to build up an as far as possible axis-parallel restoring force, a centering bolt, in particular a telescopic centering bolt, for the damping elements can be arranged between the plates, in particular in the center of the damping elements. A receiving body can be formed in a particularly simple manner in that the receiving body has a flange plate which is preferably welded to the coupling piece and to which is welded a tubular portion whose other end is releasably closed by a cover. Advantageously, one damping plunger then passes by its plunger shaft through the flange plate and the other damping plunger passes by its plunge shaft through the cover. By means of a releasable cover, the damping system can be installed in a relatively simple manner in the receiving body and be arranged there with prestress. With further preference, a plurality of damping elements which are preferably spaced apart by intermediate disks are arranged between the damping plungers. The damping elements can be disk springs but also other, elastically deformable damping elements by means of which a restoring force can be applied. It is particularly advantageous if the intermediate disks are centered on the inner casing of the tubular portion of the receiving body. With further preference, each intermediate disk can be provided with a centering bolt piece projecting on both sides beyond the disk surface. Provided between the centering bolt pieces, in any case in the starting state of the damping system, is preferably a sufficient air gap so that the relative displacement between the two damping plungers can be produced over a sufficiently large travel.

To provide relative guidance between the sliding sleeve and receiving body, the receiving body can form, in particular with its outer casing, guide means for the sliding sleeve. In one embodiment, as guide means the outer casing can be provided with a wedge-shaped guide plate. Alternatively or in addition, the covers and/or a cover and also the flange plate can form guide means for the sliding sleeve, for which purpose these then project at least radially beyond the tubular portion and are preferably formed with a curvature on a lateral surface parallel to the direction of movement. Through the radial projection, the lateral surface of the two covers or of the one cover and of the flange plate come exclusively into contact with the inner surface of the tubular casing piece of the front part. As a result, there is formed a defined bearing surface between the receiving body, which receives the damping system and is connected fixedly in terms of movement to the chain, and the traction carriage body which receives said receiving body in an axially displaceable manner, said bearing surface reliably avoiding inclinations of the receiving body and of the damping system even under high impact loads or alternating loads. According to a particularly advantageous embodiment, each cover can be provided with an annular collar which axially overlaps the ends of the tubular portion in order to make possible an optimally elongate guide surface and at the same time a flat curvature on the lateral surface.

As has already been described further above, the intermediate disks can be centered on the inner casing of the tubular portion. According to a further embodiment variant, the damping elements can also be arranged on a central tensioning rod and the damping plungers have on the plate side a blind hole as movement clearance for the tensioning rod. In order to improve the guidance of the damping plungers, the inner casing of the tubular portion can be provided, in the region of the ends, with an additional, in particular finer surface treatment and, if appropriate as a result of this, a larger inside diameter, wherein the additional surface treatment preferably only occurs along the possible guide path for the plungers. The end pieces of the tubular casing piece can also be provided on the inside with an additional surface treatment, such as, for example, a precision grinding or a hardening, in order to further improve the sliding behavior between the receiving body for the damping device and the traction carriage body. The damping elements can be prestressed via the tensioning rod in order to produce as short as possible a spring travel. As known per se, the stop surfaces are preferably provided with vertically extending slots in which plow body-side strips engage in the mounted state of the traction carriage.

The sliding sleeve can comprise an open tubular casing shell, wherein in one embodiment variant a guide beam which extends up to both stop surfaces is arranged preferably parallel to a marginal edge of the tubular casing shell. With further preference, the tubular casing shell can be provided with at least one longitudinal strip on the outer periphery in order to improve the movement-fixed, at the same time releasable locking between the sliding sleeve and receptacle in the traction carriage body.

These and other objects, aspects, features, developments, embodiments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
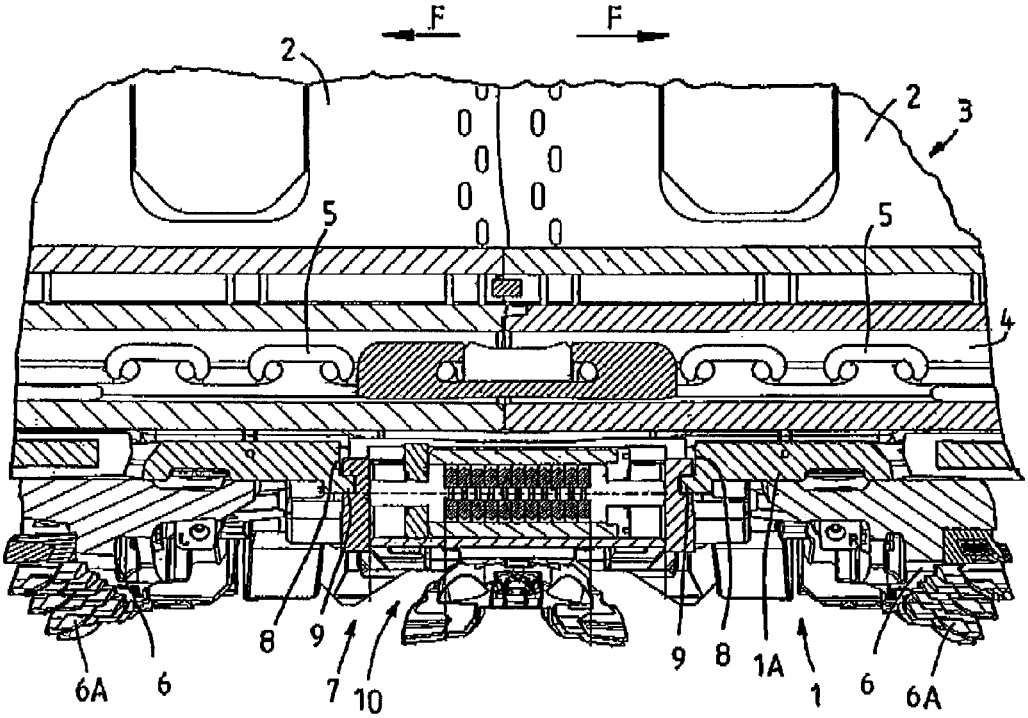
FIG. 1 shows a mining plow, guided on a conveyor, with a traction carriage according to the invention in plan view, partially cut away.

Referring now to the drawings wherein the showings are for the purpose of illustrating preferred and alternative embodiments of the invention only and not for the purpose of limiting the same, FIG. 1 shows in its entirety, with reference sign 1, an underground mining plow which is guided by its plow body 1A via guide devices which are not represented further, on a machine guide which is built onto a conveyor 3 indicated schematically via the individual pan sections 2. The machine guide and the conveyor 3 comprise inter alia a chain channel 4 in which the tension strand 5 of a plow chain extends in order to move the underground mining plow 1 parallel to the conveyor 3 in the longwall. For both directions of travel F, the mining plow 1 has in each case a pivotable cutter carrier 6, wherein, depending on the direction of travel F, in each case one of the two cutter carriers 6 removes coal or other materials on the working face of an underground longwall using the associated cutters 6A, while the other cutting carrier is inactive. With the tension strand 5 of the plow chain, the mining plow 1 can in each case be drawn back and forth between the longwall ends, and the transmission of force between the plow chain and mining plow 1 takes place via a traction carriage, shown in its entirety by reference sign 10, which is inserted in a cavity 7 which is open to the underside of the mining plow 1. The cavity 7 is bounded in both directions of travel F by counterstop surfaces 8 of the plow body 1A which each have a vertically extending, projecting strip 9 for centering and guiding the traction carriage 10 in the cavity 7. A mining plow 1 having the above features and also a traction carriage 10 which can be inserted into the cavity 7 is known to a person skilled in the art, and therefore a further description is not given here. The invention relates to the configuration of the traction carriage 10, the structure of which is now explained with reference to FIGS. 2 to 5.

Figure 2:
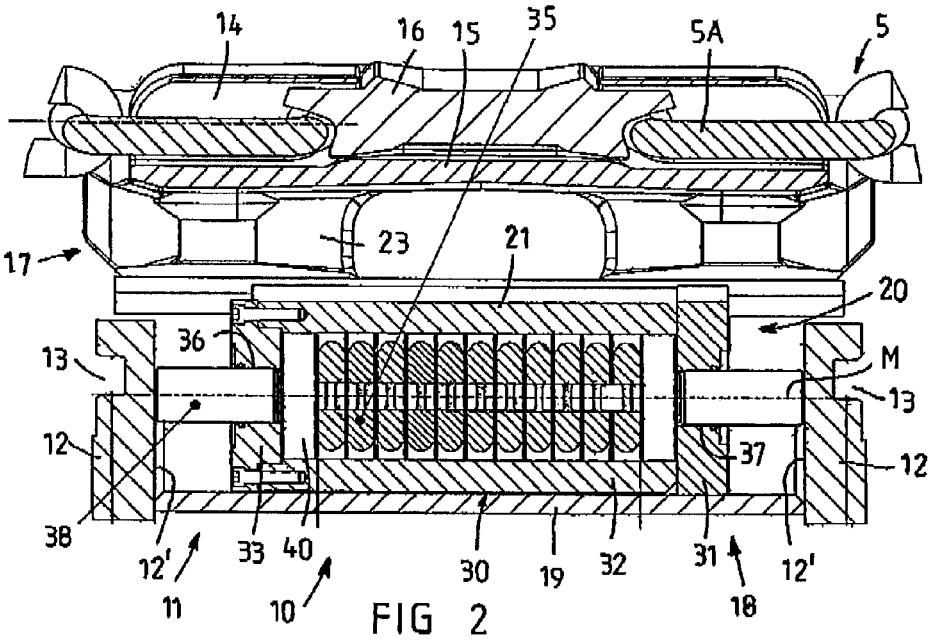
FIG. 2 shows the traction carriage according to the invention with attached chain belts in a basic position, partially cut away.

FIG. 2 shows the traction carriage 10 in the same stress state as in FIG. 1. The traction carriage 10 has a front part 11 which is bounded on both sides, i.e. for both directions of travel, in each case by a stop surface 12 which, for interacting with the strips (9, FIG. 1) in the cavity of the plow body, are in each case provided at their outer side with a vertically extending slot 13. On the rear side of the traction carriage 10 is formed a relatively strong coupling piece 14 which projects upwardly approximately to the same height as the front part 11 and on which the chain members 5A of the tension strand 5 of the plow chain are connected in order to move the mining plow via the traction carriage 10. The coupling piece 14 can at the same time form, together with an intermediate wall 15 situated adjacent to the front part 11, a guide block for the traction carriage 10 in the chain channel of the conveyor. Reference sign 16 is used in the figures to depict a securing member for the chain links 5A on the coupling piece 14. Between the coupling piece 14 and the front part 11 is formed a guide recess 17 which is bounded by the intermediate wall 15 and which interacts with a corresponding guide strip on the machine guide of the conveyor. The traction carriage 10 is provided according to the invention with a damping device 20 which is integrated into the front part 11 of the traction carriage 10 and by means of which it is ensured that, even with changes of direction of travel or obstructions during the plow travel, no excessively strong fluctuations occur in the chain tensioning force of the plow chain and/or the wear between the interacting stop surfaces 12 and counterstop surfaces (8, FIG. 1) is also limited in the plow body. The structure of the damping device 20 integrated into the front part 11 will now be explained with additional reference to FIGS. 3 to 5, wherein the same reference signs will be used in the figures as in FIGS. 1 and 2.

The damping device 20 comprises a plurality of interacting parts or assemblies which make it possible for the coupling piece 14 to be able to move relative to the stop surfaces 12 counter to the restoring force of a damping system of the damping device 20. In order to achieve this, the two stop surfaces 12 which interact with the counterstop surfaces on the plow body are a component part of a flexurally rigid, stable sliding sleeve 18 which is formed by connecting the two stop surfaces 12 by means of a tubular casing piece 19 extending between their inner surfaces 12'. The ends of the tubular casing piece 19 can be welded, for example, to the inner sides 12' of the stop surfaces 12. The damping device 20 also comprises a receiving body 30 for a damping system which here has a total of 11 damping elements 35. The receiving device 30 consists of a closed, cylindrical body with a flange plate 31, a cylindrical tubular portion 32 whose one end is welded to the flange plate 31, and a cover 33 which can be releasably screwed by means of screws 34 to the other end of the tubular portion. At least the flange plate 31 and, if appropriate, also the tubular portion 32 are connected fixedly in terms of movement to the coupling piece 14, for example via webs 23 which downwardly define a guide recess 17 between an upwardly protruding wall 21 of the front part 11 and the intermediate wall 15. Both the flange plate 31 and the cover 33 have a passage 36 or 37 in each case parallel to the center axis M of the sliding sleeve 18 or of the receiving body 30, which passages 36, 37 are each penetrated by a plunger shaft 38 of a damping plunger 39. The plunger shafts 38 of both damping plungers 39 are each connected in one piece to a plate 40. The plates 40 of both damping plungers 39 are arranged in the interior of the receiving body 30 in such a way that, in the normal stress state of the damping elements 35, the plate 40 of the first damping plunger 39 is pressed with prestress against the inner sides of the flange plate 31 and the plate of the second damping plunger 39 is pressed against the cover 33. This stress state of the damping elements 35, which normally only occurs when the plow chain exerts a tensile force on the traction carriage which is smaller than the prestress of the damping elements 35, is illustrated in FIG. 2.

Figure 3:
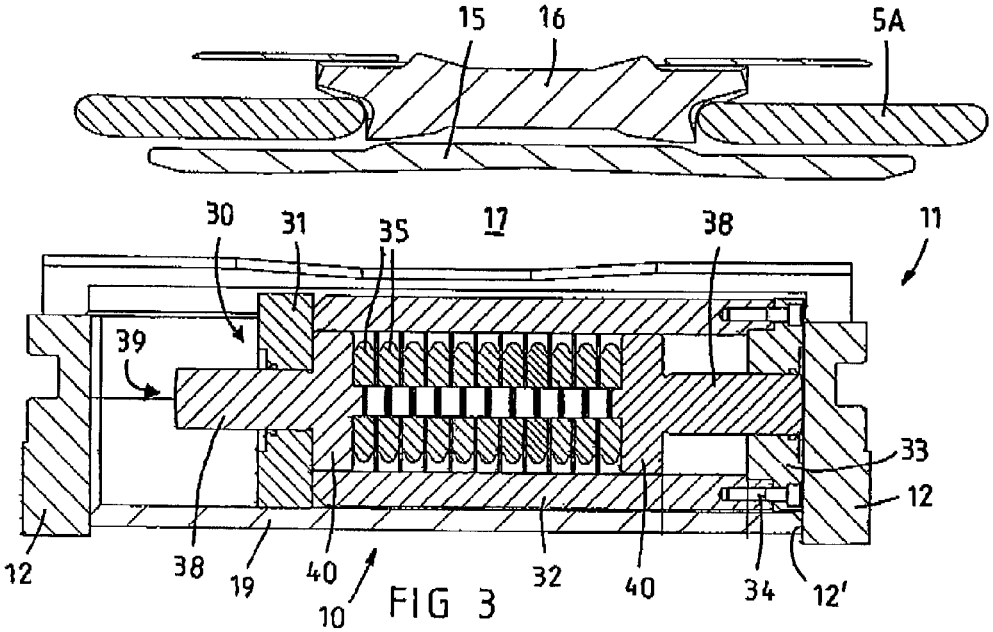
FIG. 3 shows the traction carriage according to FIG. 2 in operational use with the damping travel taken up.

If now a larger tensile force is exerted on the coupling part 14 via the chain links 5A of the traction chain 5 in order to move the traction carriage 10 and the mining plow in the direction of travel, the receiving body 30 or the entire coupling part 14 moves in the traction direction of the plow chain 5 toward the stop surface 12 situated in the direction of travel F, that is to say relative to the stop surfaces 12 and the tubular casing piece 19 of the sliding sleeve which is seated virtually play-free in the cavity of the plow body. This state is particularly clearly illustrated in FIG. 3, in which the cover 33 of the receiving body bears directly against the inner side 12' of the right stop surface 12. From the starting position according to FIG. 2 to the end position according to FIG. 3, a thrust which is damped by the damping elements 35 particularly with regard to impact loads is exerted on the plow body via the stop surface 12 in order to move the plow body to the right for example. A comparison of the representations of FIGS. 2 and 3 shows that the securing member 16 and the intermediate wall 15, which is formed integrally in the coupling piece 14, lie offset to the right with respect to the representation in FIG. 2, since the coupling piece 14 has moved relative to the stop surfaces 12. The displacement of the receiving body 30 relative to the sliding sleeve 18 here takes place with a build up of a restoring force in the damping elements 35 corresponding to their spring characteristic and to the maximum displacement travel between the extended state of the damping plunger 39 in the representation according to FIG. 2 and the inserted state of the damping plunger 39 in the representation according to FIG. 3. Through a suitable choice of damping elements 35 it can here be ensured that in any case under normal loading, a small spring travel still remains in order to be able to permanently achieve a damping effect with the damping device 20 during the plow travel. By prestressing the damping elements 35 it is possible, for example, to achieve a damping for all forces between 100 kN and 500 kN. The receiving body 30 for the damping plungers 39 and the damping elements 35 which is arranged inside the sliding sleeve 18 can at the same time have or form sliding guides or the like for the sliding sleeve 18.

Figure 5:
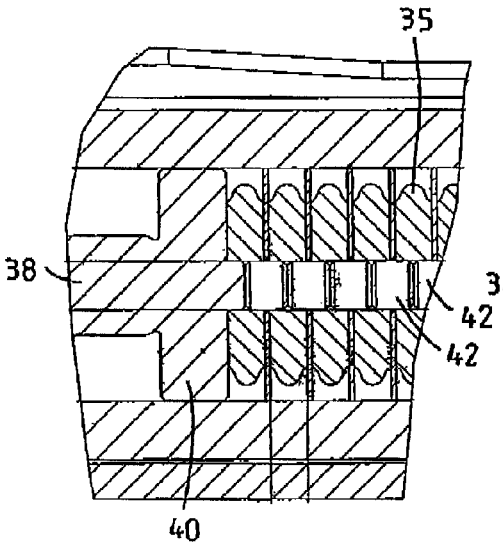
FIG. 5 shows, in a view corresponding to FIG. 4, the damping elements with the complete action of the damping device.
Figure 4:
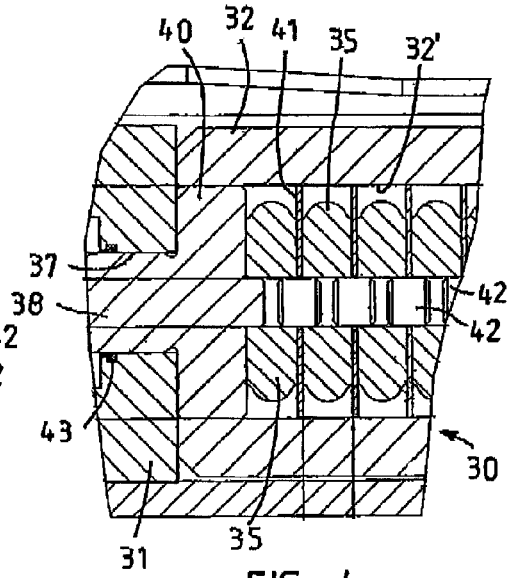
FIG. 4 shows, in a detail view of the damping system, the damping elements in the basic position.

The two different stress states of the damping elements 35 can be seen particularly clearly from FIGS. 4 and 5. Here, FIG. 4 shows the damping elements 35 in the starting state in which the damping elements 35 are clamped in with a prestress of, for example, approximately 100 kN between the flange plate 31 and the cover, which is not shown here. Arranged in each case between two damping elements 35 is an intermediate disk 41 which is centered on the inner casing 32' of the tubular piece 32. By contrast, the damping elements 35 have a sufficient spacing from the inner casing 32' and are centered via relatively short bolt pieces 42 which are each arranged centrally with respect to the center axis of the receiving body 30 and project on both sides with a uniform spacing beyond the intermediate disks 41. The bolt pieces 42 and the intermediate disks 41 can be welded to one another. It can be seen clearly from the representation in FIG. 4 that an air gap is formed in each case between two bolt pieces 42, wherein the total length of all the gaps between the bolt pieces 42 corresponds to the maximum spring travel or limits said travel. The state of the stressing of the damping elements 35 with maximum restoring force is shown in FIG. 5, in which a gap spacing is no longer present between the individual bolt pieces 42. In order to protect the damping elements 35 in the interior of the receiving body from soiling and the like, the passages 37 in the flange plate 31 and the passage in the cover are each assigned rod seals 43 which bear in a sealing manner on the plunger shaft 38.

Figure 6:
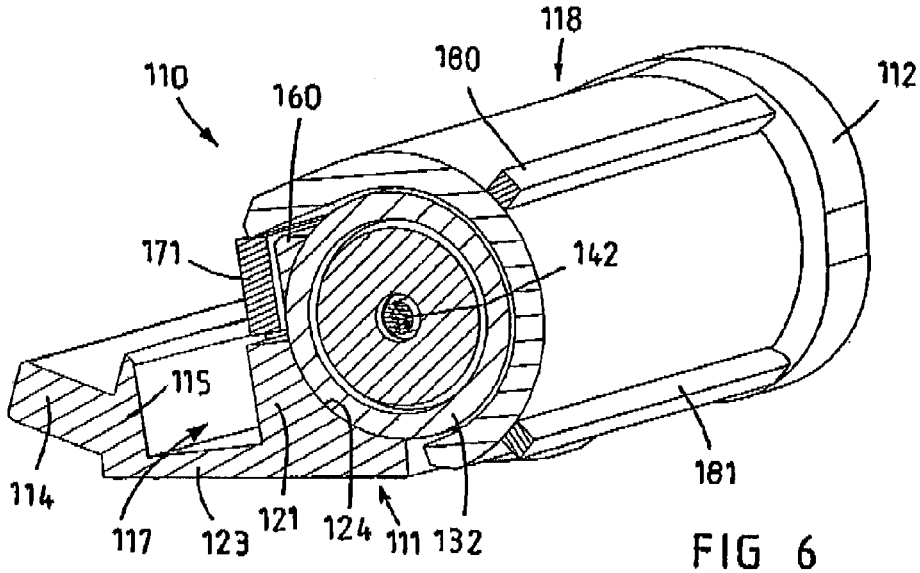
FIG. 6 shows, schematically in a perspective view, a traction carriage according to the invention according to a second embodiment, partially cut away.
Figure 7:
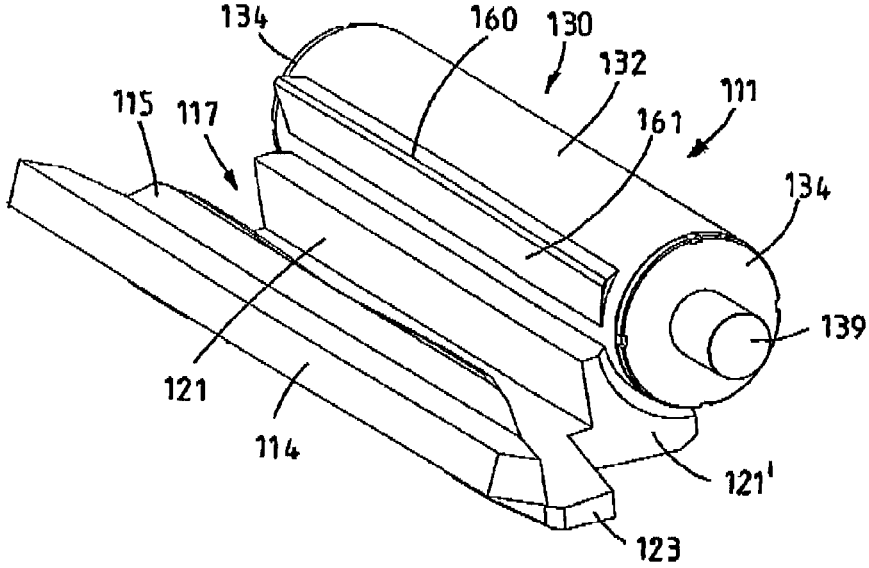
FIG. 7 shows, in a perspective view, the traction carriage from FIG. 6 with the sliding sleeve demounted.
Figure 8:
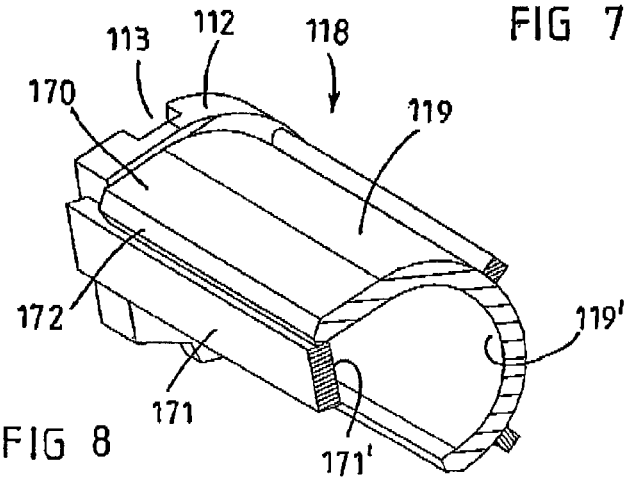
FIG. 8 shows, in a perspective view, the sliding sleeve of the traction carriage from FIG. 6.

FIGS. 6 to 8 show, in a schematically simplified manner, a further particularly advantageous embodiment of a traction carriage 110 according to the invention of multipart design with a coupling piece 114 which, in the schematically simplified representation, is represented without hooks for the chain connection and leads into an intermediate wall 115 which bounds the guide recess 117 on the goaf side. On the bottom of the traction carriage 110 is here formed a continuous web 123 which connects the intermediate wall 115 of the coupling part 114 to a relatively strong, vertically protruding wall 121 of the front part 111. In the exemplary embodiment shown, the coupling part 114 with the connected intermediate wall 115, the bottom web 123 and the wall 121 consists of a cast part, but it could also consist of a welded construction. It can be seen clearly from FIGS. 6 and 7 that the upwardly protruding wall 121 is provided, on the front surface facing the working face during operation, with a half-rounded portion 124 on which the tubular portion 132 partially bears and is preferably welded by its cylindrical outer wall. The tubular portion 132 projects on both sides beyond the end surfaces 121' of the wall 121 which points in the direction of travel, since said wall has a slightly shorter length between its two end surfaces 121' than the length of the tubular portion 132. Both ends of the tubular portion 132 are closed by means of covers 134; both covers 134 can have a threaded shoulder which is screwed onto an internal thread within the tubular portion 132. On the lateral surface of the tubular portion 132 on the goaf side, above the wall 121 and situated substantially opposite the coupling piece 114 or the intermediate wall 115, a wedge-shaped guide beam 160 is welded to the tubular portion 132 and its front surface 161 on the goaf side and pointing toward the guide recess 117 is planar and extends substantially normal and parallel to the boundary wall of the wall 121. The tubular portion 132 of the receiving body 130 again receives a damping device of which only the damping plunger 139 passing through the covers 134 is represented in FIG. 7 and an intermediate bolt piece 142 is represented in FIG. 6.

The sliding sleeve 118, which is represented in detail in FIG. 8, has an approximately C-shaped tubular casing shell 119 which is extended on one leg and which is guided over a relatively large area by its half-round inner surface 119' on the outer circumference of the tubular portion 132 of the receiving body 130. For additional guidance, a strong guide strip 171 is welded to the free marginal portion 172 of the leg 170 of the tubular casing shell 119 that extends the C-shaped cross section, said guide strip interacting with the wedge-shaped guide beam 160 during the relative displacement of the coupling part 114 and sliding sleeve 118 and ensuring a parallel guiding of the two parts with respect to one another. The planar inner surface 171' here lies directly opposite the front surface 160 of the wedge-shaped guide beam 160, as can be seen particularly well from FIG. 6. The guide beam 171, which is preferably welded to the free edge 172 of the tubular casing shell 119, extends between both end stops 112 of the sliding sleeve 118 and is also preferably welded to both stop surfaces 112. Furthermore, in the exemplary embodiment shown, two longitudinal strips 180, 181 arranged with a circumferential offset with respect to one another are welded to the outer circumference of the tubular casing shell 119 and can engage in grooves in the cavity in the plow body or interact with a boundary edge of the cavity on the plow body in order to improve the movement-fixed reception of the sliding sleeve 118 in the cavity in the plow body in addition to the vertically extending slots 113 in the stop surfaces 112.

Figure 9:
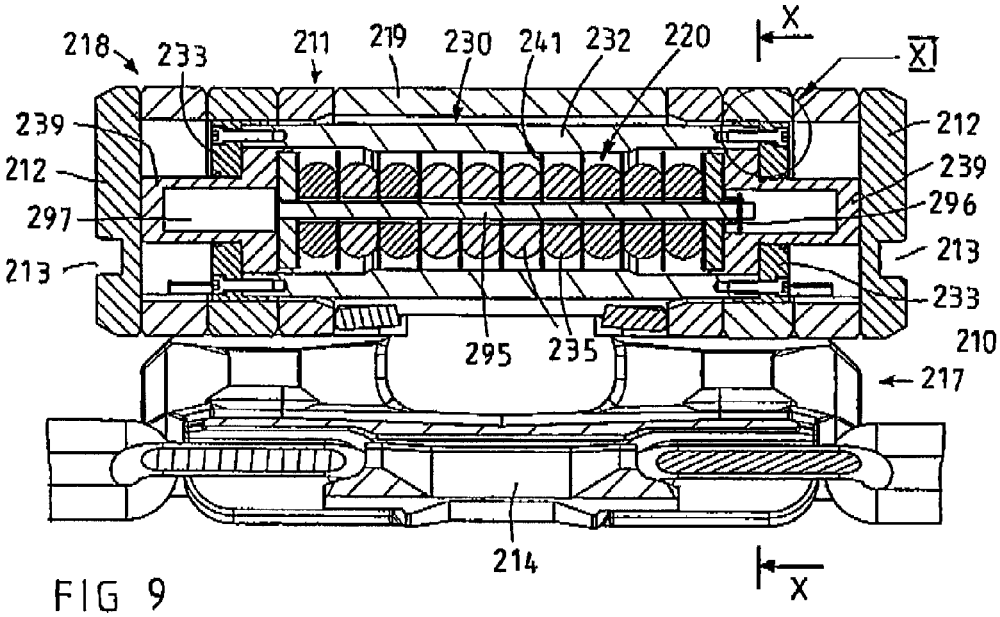
FIG. 9 shows a third exemplary embodiment of a traction carriage according to the invention with attached chain belts in the basic position, partially cut away.
Figure 10:
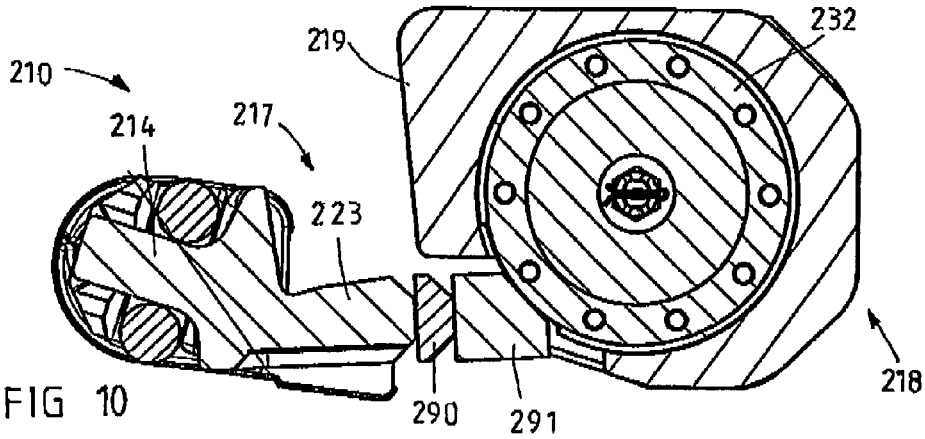
FIG. 10 shows a sectional view along X-X in FIG. 9.
Figure 11:
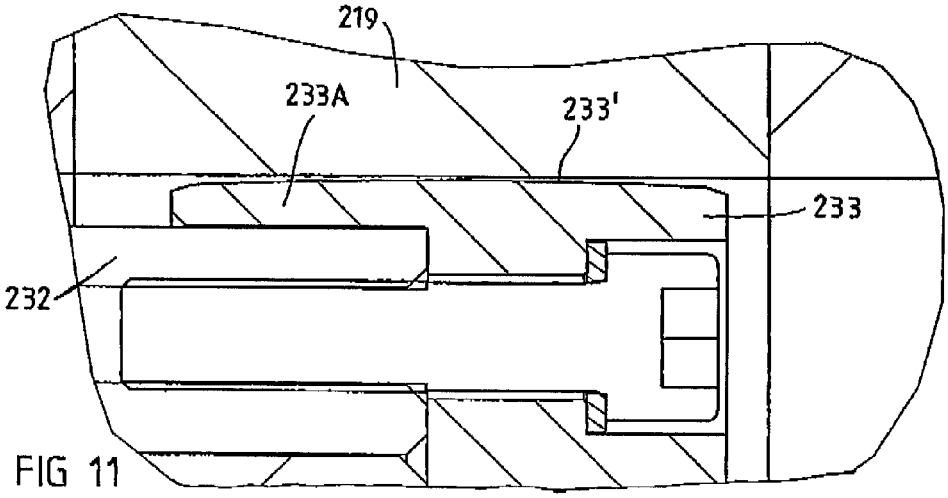
FIG. 11 shows a detail view according to XI in FIG. 9.

FIGS. 9 to 11 show a third exemplary embodiment of a traction carriage which is designated in its entirety by reference sign 210. Here too, a front part 211 which forms the sliding sleeve 218 is bounded in both directions of travel by respective stop surfaces 212 which are provided on their respective outer sides with a vertically extending slot 213 in order to interact with the strips on the plow body side. Arranged on the rear side of a guide recess 217 is a coupling piece 214 to which the two chain strands of the plow chain are connected and which is welded to the outer circumference of the tubular portion 232 of a receiving body 230 by way of an integral bottom web 223, which downwardly bounds the guide recess 217, via a plurality of strong strips 290, 291. The sliding sleeve 218 can displaceably receive the receiving body 230 by means of a casing piece 219 which consists of a cast part and has flat outer sides, wherein the casing piece 219 preferably interconnects the two stop surfaces 212 in one piece, even if the casing piece is represented in FIG. 9 as a multipart welded construction. As a departure from the preceding exemplary embodiment, the tubular portion 232 is closed on both sides with respect to the receiving body 230 for a damping device 220 by means of detachable covers 233 which are here formed identically with respect to one another and which are screwed terminally onto the ends of the tubular portion 232. The damping device 220 comprises a plurality of suitable damping elements 235 which are in each case separated from one another by intermediate disks 241 which are centered on the inner casing of the tubular portion 232, and are premounted under prestress by means of a tensioning rod 295 which passes centrally through the damping elements 235 and the intermediate disks 241. A tensioning nut 296 screwed onto one end of the tensioning rod 295 can be used to place the damping element 220 under sufficient prestress in order, in the basic state, to press the two damping plungers 239 passing centrally through the covers 233 against the inner sides of the stop surfaces 212. FIG. 9 shows this basic position. Depending on the direction of travel, the coupling part 214, which is connected virtually rigidly to the receiving body 230, can move relative to the stop surfaces 212 until one of the covers 233 butts against the inner surface of the adjacent stop surface 212. The blind holes 297 in the damping plungers 239 ensure that the free end of the tensioning rod 295 has sufficient play to allow the change in spacing between the damping plungers 239 counter to the restoring force of the damping elements 235.

In FIG. 9, the casing piece 219 which receives the receiving body 230 is represented in multiple parts. However, it preferably consists of a one-piece cast part or the like. In order to optimize the relative movements between the receiving body 230 on the one hand and the casing piece 219 on the other hand, the two covers 233 are designed as guide means which produce as exact a guidance of the receiving body 230 on the inner circumference of the casing piece 219 as possible. As is shown particularly clearly in FIG. 11, the covers 233 protrude radially with sufficient projection by their radial lateral surface 233' beyond the tubular piece 232 which connects the covers 233. The cover pieces 233 have an annular collar 233A which projects outwardly beyond the ends of the tubular piece 232 so that, in the mounted state of the traction carriage 210, only the lateral surface 233' of the covers 233 can come to bear against the inner casing of the casing piece 219. In order to further improve the guidance between the casing piece 219 and receiving body 230, the lateral surface 233' here extends with curvature in the direction of travel or movement or in the axial direction of the receiving body 230, resulting in an optimized bearing and sliding surface between the receiving body 230 and the casing piece 219. In the end regions, the casing piece 219 can be provided inwardly with an additional surface processing in order to minimize friction losses during the relative movement of the receiving piece 230 with respect to the casing piece 219 in operational use. In a similar manner, the inner surface of the tubular piece 232 can also be provided close to the ends with an additional surface processing in order to improve the sliding behavior of the damping plungers 239, in particular their plate-side ends, during the damping movement. The aforementioned measures make it possible to achieve, even under high, impact-like loads, material-protecting relative movements between the casing piece 219 and receiving body 230 together with damping device 220.

For a person skilled in the art, numerous modifications will emerge from the preceding description which are intended to come within the scope of protection of the appended claims. In particular, the design of the stop surfaces, the coupling piece and the receiving body and also the number and design of the damping elements can vary depending on the design, size and weight of the mining plow and the plow chains used. By increasing or reducing the spring travel or by another choice of damping elements, it is possible to adjust the maximum damping force up to which a damping is produced and excess chain stresses can be damped. The damping elements can in particular consist of disk springs but also of other, elastically deformable damping elements which store a restoring force.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A traction carriage for an underground mining plow, comprising:

a traction carriage body which is insertable into a cavity in a plow body and which comprises a guide recess;

a coupling piece on a rear side of the guide recess for fastening a plow chain;

a front part on a front side of the guide recess, the front part having ends pointing in the direction of travel that form stop surfaces for interacting with counterstop surfaces in the cavity of the plow body;

a damping device having a receiving body arranged between the stop surfaces and having a damping action in both directions of travel is integrated into the front part of the traction carriage, the damping device having for each direction of travel a damping plunger whose plunger shaft is displaceable in opposition to a restoring force of at least one damping element relative to the other damping plunger, each damping plunger having a plate on whose front side the plunger shaft is formed and against whose rear side the damping element presses; and a telescopic centering bolt for the damping element that is arranged between the plates;

wherein the coupling piece is movable relative to the stop surfaces in opposition to the restoring force.

2. The traction carriage as claimed in claim 1 wherein the receiving body is connected fixedly in terms of movement to the coupling piece and serves to receive the at least one damping element.

3. The fraction carriage as claimed in claim 2, wherein the stop surfaces form the ends of a sliding sleeve in whose interior the receiving body is movably arranged and the inner sides of the stop surfaces form the movement stops for the relative movement between the sliding sleeve and receiving body.

4. The fraction carriage as claimed in claim 3, wherein the receiving body includes a guide plate for the sliding sleeve.

5. The fraction carriage as claimed in claim 4, wherein the guide plate includes a wedge shape.

6. The traction carriage as claimed in claim 3, wherein the sliding sleeve includes an open tubular casing shell and a guide beam.

7. The traction carriage as claimed in claim 6, wherein the guide beam extends parallel to a marginal edge of the tubular casing shell and extends to both stop surfaces.

8. The traction carriage as claimed in claim 6, wherein the tubular casing shell further includes an outer periphery with at least one longitudinal strip on the outer periphery.

9. The traction carriage as claimed in claim 2, wherein the receiving body has a flange plate which joined to the coupling piece and to which is joined to a tubular portion at one end and whose other end is releasably closed by a cover.

10. The fraction carriage as claimed in claim 9, wherein at least one of the cover and the flange plate includes a guide surface for the sliding sleeve, the guide surface projecting radially beyond the tubular portion.

11. The fraction carriage as claimed in claim 10, wherein the guide surface includes a curvature in the direction of the receiving body.

12. The traction carriage as claimed in claim 2, wherein the receiving body has a tubular portion which is connected fixedly in terms of movement to the coupling piece.

13. The traction carriage as claimed in claim 12, wherein the tubular portion is closed at both ends by means of releasable covers.

14. The traction carriage as claimed in claim 13, wherein the receiving body includes a guide surface for the sliding sleeve.

15. The fraction carriage as claimed in claim 14, wherein the releasable covers are provided with an annular collar which axially overlaps the ends of the tubular portion.

16. The traction carriage as claimed in claim 1, wherein the receiving body has a flange plate which joined to the coupling piece and to which is joined to a tubular portion at one end and whose other end is releasably closed by a cover, wherein one of the damping plungers passes with its plunger shaft through the flange plate and the other of the damping plungers passes through the cover.

17. The fraction carriage as claimed in claim 16, wherein a plurality of damping elements spaced apart by intermediate disks are arranged between the damping plungers.

18. The traction carriage as claimed in claim 17, wherein the intermediate disks are centered on an inner casing of the tubular portion.

19. The fraction carriage as claimed in claim 1, wherein a plurality of damping elements spaced apart by intermediate disks are arranged between the damping plungers.

20. The traction carriage as claimed in claim 19, wherein each intermediate disk is provided with a piece of the telescopic centering bolt projecting on both sides beyond the disk surface.

21. The traction carriage as claimed in claim 1 wherein the at least one damping element is arranged on at least one of the telescopic centering bolt and the damping plungers.

22. The traction carriage as claimed in claim 1 wherein the at least one damping element is arranged on the telescopic centering bolt and the damping plungers have on the plate side a blind hole as movement clearance for the telescopic centering bolt.

23. A fraction carriage for an underground mining plow, comprising:

a traction carriage body which is insertable into a cavity in a plow body and which comprises a guide recess;

a coupling piece on a rear side of the guide recess for fastening a plow chain;

a front part on a front side of the guide recess, the front part having ends pointing in the direction of travel that form stop surfaces for interacting with counterstop surfaces in the cavity of the plow body;

a damping device having a receiving body arranged between the stop surfaces and having a damping action in both directions of travel is integrated into the front part of the traction carriage, the receiving body having a flange plate joined to the coupling piece and to which is joined a tubular portion at one end and whose other end is releasably closed by a cover;

the damping device having for each direction of travel a damping plunger whose plunger shaft is displaceable relative to the other damping plunger in opposition to a restoring force of a plurality of damping elements spaced apart by intermediate disks, wherein one of the damping plungers passes with its plunger shaft through the flange plate and the other of the damping plungers passes through the cover;

wherein the coupling piece is movable relative to the stop surfaces in opposition to the restoring force.

24. The traction carriage as claimed in claim 23, wherein each damping plunger has a plate which is arranged in the receiving body and on whose front side the plunger shaft is formed and against whose rear side the damping elements press.

25. The traction carriage as claimed in claim 24, further including a centering bolt for the damping elements that is arranged between the plates.

26. The traction carriage as claimed in claim 25, wherein the centering bolt is a telescopic centering bolt.

27. A fraction carriage for an underground mining plow, comprising:

a traction carriage body which is insertable into a cavity in a plow body and which comprises a guide recess;

a coupling piece on a rear side of the guide recess for fastening a plow chain;

a front part on a front side of the guide recess, the front part having ends pointing in the direction of travel that form stop surfaces for interacting with counterstop surfaces in the cavity of the plow body;

a damping device having a receiving body arranged between the stop surfaces and having a damping action in both directions of travel is integrated into the front part of the traction carriage, the damping device having for each direction of travel a damping plunger whose plunger shaft is displaceable relative to the other damping plunger in opposition to a restoring force of a plurality of damping elements spaced apart by intermediate disks;

wherein the coupling piece is movable relative to the stop surfaces in opposition to the restoring force.

28. The traction carriage as claimed in claim 27, wherein each intermediate disk is provided with a centering bolt piece projecting on both sides beyond the disk surface.

29. A fraction carriage for an underground mining plow, comprising:

a traction carriage body which is insertable into a cavity in a plow body and which comprises a guide recess;

a coupling piece on a rear side of the guide recess for fastening a plow chain;

a front part on a front side of the guide recess, the front part having ends pointing in the direction of travel that form stop surfaces for interacting with counterstop surfaces in the cavity of the plow body;

a damping device having a receiving body arranged between the stop surfaces and having a damping action in both directions of travel is integrated into the front part of the traction carriage, the damping device having for each direction of travel a damping plunger whose plunger shaft is displaceable in opposition to a restoring force of at least one damping element relative to the other damping plunger, the damping element arranged on a central tensioning rod, and each damping plunger having a blind hole as movement clearance for the tensioning rod;

wherein the coupling piece is movable relative to the stop surfaces in opposition to the restoring force.

30. The traction carriage as claimed in claim 29 wherein the receiving body is connected fixedly to the coupling piece and serves to receive the damping element and damping plungers.

31. The traction carriage as claimed in claim 29, wherein the stop surfaces form the ends of a sliding sleeve in whose interior the receiving body is movably arranged and the inner sides of the stop surfaces form the movement stops for the relative movement between the sliding sleeve and receiving body.

* * * * *